US005305717A

United States Patent [19]

Wichelhaus

[11] Patent Number: 5,305,717

[45] Date of Patent: Apr. 26, 1994

[54] ARRANGEMENT FOR THE AUTOMATICALLY CONTROLLED VARYING OF THE RELATIVE ROTATING POSITION OF SHAFTS IN AN INTERNAL-COMBUSTION ENGINE

[75] Inventor: Donatus Wichelhaus, Börtlingen, Fed. Rep. of Germany

[73] Assignee: Dr. Ing. h.c.F. Porsche AG, Weissach, Fed. Rep. of Germany

[21] Appl. No.: 977,441

[22] PCT Filed: Aug. 16, 1991

[86] PCT No.: PCT/EP91/01553

§ 371 Date: Jul. 23, 1993

§ 102(e) Date: Jul. 23, 1993

[87] PCT Pub. No.: WO92/04530

PCT Pub. Date: Mar. 19, 1992

[30] Foreign Application Priority Data

Aug. 31, 1990 [DE] Fed. Rep. of Germany ..... 4027631

[51] Int. Cl.[5] ..... F01L 1/34

[52] U.S. Cl. ..... 123/90.17; 123/90.31; 464/2

[58] Field of Search ..... 123/90.15, 90.17, 90.31; 464/1, 2, 160

[56] References Cited

U.S. PATENT DOCUMENTS

| | | | |
|---|---|---|---|
| 4,754,727 | 7/1988 | Hampton | 123/90.17 |
| 4,841,924 | 6/1989 | Hampton et al. | 123/90.17 |
| 4,856,465 | 8/1989 | Denz et al. | 123/90.17 |
| 4,862,843 | 9/1989 | Kawamoto et al. | 123/90.17 |
| 4,895,113 | 1/1990 | Speier et al. | 123/90.17 |
| 4,896,754 | 1/1990 | Carlson et al. | 192/21.5 |
| 4,920,929 | 5/1990 | Bishop | 123/41.49 |
| 4,930,463 | 6/1990 | Hare, Sr. | 123/90.11 |
| 5,090,531 | 2/1992 | Carlson | 192/21.5 |
| 5,152,263 | 10/1992 | Danieli | 123/90.17 |
| 5,181,486 | 1/1993 | Gyurovits | 123/90.17 |

FOREIGN PATENT DOCUMENTS

| | | |
|---|---|---|
| 0274019 | 7/1988 | European Pat. Off. . |
| 0335083 | 10/1989 | European Pat. Off. . |
| 2189086 | 10/1987 | United Kingdom . |

*Primary Examiner*—Raymond A. Nelli
*Assistant Examiner*—Weilun Lo
*Attorney, Agent, or Firm*—Evenson, McKeown, Edwards & Lenahan

[57] ABSTRACT

The arrangement of the present invention provides for the automatically controlled varying of the relative rotating position of shafts in an international combustion engine, for example, a camshaft relative to a crankshaft driving it. This will influence the valve timing of an internal-combustion engine. The arrangement has an intermediate timing gear which can be axially moved between two end positions and which engages by way of a helical external and internal toothing with a driving wheel and the camshaft. An annulus, such as a stationary bearing ring, is filled with an electroviscous fluid which, by means of the application of a voltage supplied by an electronic control device, causes an axial force for the adjustment of the intermediate timing gear. An electroviscous locking bearing, which is provided between the camshaft and the intermediate timing gear, holds the intermediate timing gear in any position between the two end positions.

12 Claims, 1 Drawing Sheet

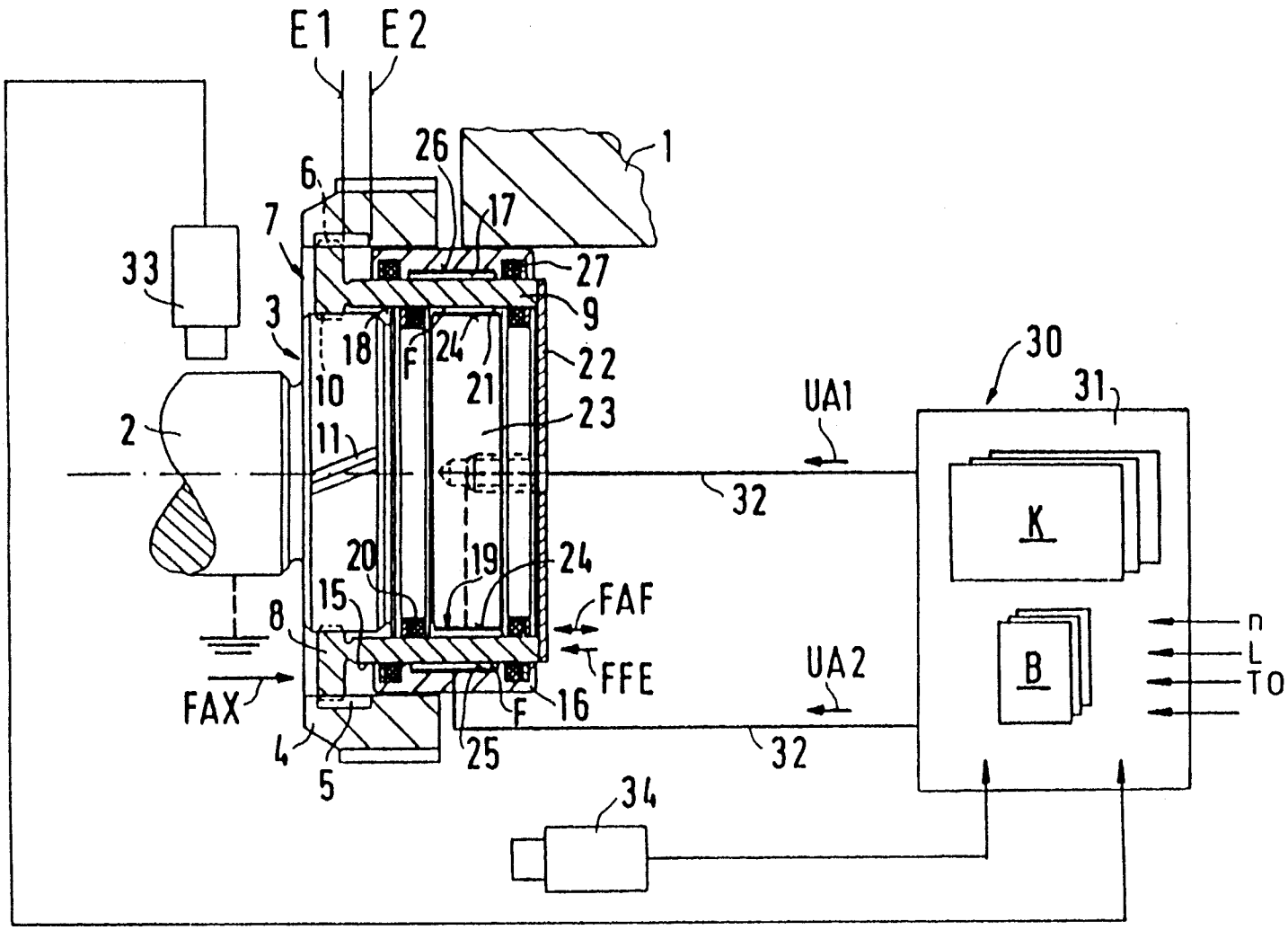
n
L
TO
K
B
30
31
UA1
UA2
32
32
34
FAF
FFE
1
27
9
22
23
24
16
17
21
19
25
26
24
E2
E1
18
10
11
20
15
5
6
7
3
8
4
FAX
33
2

ARRANGEMENT FOR THE AUTOMATICALLY CONTROLLED VARYING OF THE RELATIVE ROTATING POSITION OF SHAFTS IN AN INTERNAL-COMBUSTION ENGINE

BACKGROUND OF THE INVENTION

The present invention relates to an arrangement for the automatically controlled varying of the relative rotating position of two shafts in an internal-combustion engine, comprising at least one camshaft which can be rotated relative to a shaft driving it, as a function of parameters of the internal-combustion engine, and a driving wheel which drives the camshaft. The driving wheel carries a first toothing or set of gear teeth and, by way of a coupling member which is axially displaceable at least in two end positions, acts upon a second toothing connected with the camshaft. At least one of the toothings is a helical toothing.

It is known to adapt the valve timing of an internal-combustion engine to its rotational speed in order to be able to operate it optimally in a rotational speed range that is as wide as possible. As a result, the torque, the performance, the exhaust emission, the idling action and the fuel consumption can be improved.

One possibility of changing the valve timing during the operation of the internal-combustion engine comprises rotating the intake canshaft in its position relative to the crankshaft driving it by means of a phase converter. For example, European Patent Document EP 0 335 083 shows a coupling member that is axially shifted and which is coaxially surrounded by the wheel driving the camshaft, as a function of oil pressure. The coupling member carries two toothings of which at least one is helically geared and which interact with one corresponding toothing respectively on the camshaft or in the wheel. Disadvantages of this construction are the high expenditures with respect to components for the leading-in and gradual shut-off of the pressure oil as well as the large size.

The British Patent Document GB-21 89 086 shows a camshaft which is coaxially surrounded by a hollow shaft section which carries a can for the actuating of a charge cycle valve. An annular gap constructed and sealed off between the camshaft and the shaft section is filled with an electroviscous fluid (EVF). By feeding an electric voltage between the camshaft and the insulatedly held shaft section, the viscosity of the EVF is increased to such an extent that a rigid coupling is created so that the shaft section rotates synchronously with the camshaft. When the voltage is disconnected, the electroviscous fluid will liquify, whereby the shaft section is uncoupled from the camshaft. With this arrangement, for example, a charge cycle valve can be connected and disconnected, or the valve overlap can be varied between intake valves and exhaust valves. If the valve overlap is varied between intake valves and exhaust valves, this arrangement achieves the same effect that can be achieved by a change of the relative rotating position between an inlet camshaft and an outlet camshaft.

An object of the present invention is to provide an arrangement of the above-mentioned type which reduces the component expenditures and size and has a simple and low-cost construction.

This and other objects are achieved by the present invention which provides an arrangement for automatically controlled varying of a relative rotating position of two shafts in an internal-corabustion engine, the shafts including a camshaft and a second shaft, the camshaft being rotatable relative to the second shaft as a function of parameters of the internal-combustion engine. The arrangement comprises a driving wheel which drives the camshaft and carries a first toothing. A second toothing is connected with the camshaft, with at least one of the first and second toothings being a helical toothing. A coupling member is provided that is axially displaceable between at least two end positions and is arranged between the driving wheel and the camshaft to act upon the second toothing. A stationary intermediate timing gear bearing ring coaxially surrounds the coupling member at least in sections and bounds an annulus formed between the bearing ring and the coupling member. A fluid is provided in the annulus, this fluid having a viscosity which can be changed by application of voltage. An electronic control device is coupled to apply a first output voltage to the fluid, wherein application of the first output voltage to the fluid creates a braking moment that acts on the intermediate timing gear, the braking moment causing an axial force that displaces the intermediate timing gear towards one of the end positions.

One of the principal advantages achieved by the present invention is that the arrangement can rapidly change the relative rotating position and only requires a small number of components, particularly moving components. It also only requires little installation space. The coupling member which is constructed as an intermediate timing gear is surrounded coaxially at least in sections by a stationary intermediate timing gear bearing ring, in which case an annulus is bounded between the two parts which is filled with an electroviscous fluid. An output voltage, which is supplied to this fluid by an electronic control device, changes the viscosity in such a manner that a braking torque acts upon the intermediate timing gear which, because of the helical toothing, causes an axial force which shifts the intermediate timing gear into the direction of a first end position.

A construction of the first and second toothing as helical toothings, as in certain embodiments, increases the rotating angle of the camshaft with respect to the shaft driving it and blocks an unintentional pushing-back of the intermediate timing gear which is the result of an alternating non-uniform camshaft driving torque.

In certain embodiments of the invention, an axially oscillating relative movement of the intermediate timing gear on the camshaft which is caused by this driving torque is effectively damped by a diaphragm spring which is arranged between the camshaft and the intermediate timing gear and, at the same time, applies the spring force required for a restoring.

So that any rotating position can be adjusted between the two end positions, certain embodiments of the invention provide an electroviscous locking bearing between the camshaft and the intermediate timing gear. The electroviscous locking bearing is supplied with an output voltage also from the electronic control device and causes a radial pressure force which results in an axial locking force which counteracts the spring force and compensates it. The annulus as well as the locking bearing are bounded on both sides by commercially available sealing rings which are fixed in a simple manner in the intermediate timing gear bearing ring and on the camshaft.

In certain embodiments of the invention, in the annulus and on a segment of the camshaft assigned to the locking bearing, electrodes are mounted which are in direct contact with the electroviscous fluid. The electrodes are arranged in an insulated manner, in which case, either an electrically non-conductive intermediate layer is used, or the intermediate timing gear bearing ring or the segment are manufactured of a non-conductive material.

Certain embodiments of the invention provide electrically conductive connections by which the electrodes are connected to a high-voltage module of the control device. In this case, the electrode on the segment of the camshaft is supplied by a connection guided centrically into the camshaft, for example, the screwing together of the diaphragm spring and a connection extending from there radially to the electrode. An actual differential angle of rotation between the camshaft and the crankshaft is detected by way of sensors and is fed to the electronic control device. In this control device, optimal differential angles of rotation are stored in characteristic diagrams as a function of parameters of the internal-combustion engine. In lists which are logically linked with the optimal angles, the output voltages are stored.

The arrangement has a simple construction because it employs components which are required also in known oil-hydraulically or electrically operated phase converters.

The intermediate timing gear bearing ring may be constructed as a separate component or as part of the cylinder head.

The required amount of fluid is low because it must be discharged and renewed continuously.

Other objects, advantages and novel features of the present invention will become apparent from the following detailed description of the invention when considered in conjunction with the accompanying drawings.

BRIEF DESCRIPTION OF THE DRAWINGS

The drawing figure shows a schematic view of an arrangement for the automatically controlled varying of the relative rotating position of shafts in an internal-combustion engine with an electronic control device in accordance with an embodiment of the present invention.

DETAILED DESCRIPTION OF THE DRAWINGS

In an internal-combustion engine, which is not shown, a camshaft 2 which controls the charge cycle of intake valves is rotatably disposed in a cylinder head 1 which is only outlined. On the drive-side end 3 of the camshaft 2, an arrangement for changing the rotating position is arranged which rotates the camshaft 2 relative to a crankshaft which drives it and which is not shown.

The arrangement comprises a driving wheel 4 which is driven by the crankshaft and carries a first toothings or set of gear teeth 5 which is constructed as a helical internal toothing and which interacts with a corresponding external toothing or set of gear teeth 6 of a coupling member constructed as an intermediate timing gear 7. The intermediate timing gear 7 comprises a ring-shaped disk 8 and a hollow-cylindrical sleeve 9. The disk 8 carries the external toothing 6 as well as a second toothing 10 which is constructed as a helical internal toothing and which engages into a corresponding external toothing 11 on the camshaft 2. The engaging toothings 5, 6 and 10, 11 are reciprocally toothed helically in such a manner that a self-locking occurs between the camshaft 2 and the driving wheel 4.

The intermediate timing gear 7 can be axially displaced into any position between two end positions E1, E2, in which case the outer lateral surface 15 of the sleeve 9 slides in an intermediate timing gear bearing ring 16 which is stationarily arranged in the cylinder head 1. This bearing ring 16 surrounds the sleeve 9 coaxially and in this case encloses an annulus 17 constructed between the sleeve 9 and the bearing ring 16. Between an interior surface 18 of the sleeve 9 and the camshaft 2, a circular gap 19 is formed, in which case two sealing rings 20, which are arranged on the camshaft 2 at a distance from one another, bound a locking bearing 21 inside the circular gap 9.

A diaphragm spring 22 is screwed in the center into the end face of the camshaft 2 and is in elastic contact with the intermediate timing gear 7 by means of its outer edge area.

On a segment 23 of the camshaft 2 situated between the sealing rings 20, an electrode 24 is arranged which is mounted on this segment 23 in an insulated manner. Another electrode 25, which is also mounted in an insulated manner, is arranged on an exterior surface 26 which bounds an annulus 17 on the intermediate- timing-gear side. The annulus 17, which is constructed in the intermediate timing gear bearing ring 16, is sealed off on both sides by means of sealing rings 27 placed in the bearing ring 16.

The annulus 17 and the locking bearing 21 are filled with a fluid F the viscosity of which can be controlled in a wide range between "liquid" and "solid" by the application of an electric voltage. An electronic control device 30 which is assigned to the arrangement comprises a high-voltage module 31 which, via electrically conductive connections 32, provides output voltages UA1 and UA2 to the electrodes 24 and 25. The intermediate timing gear 7 which is grounded by the camshaft 2 acts as the counter electrode for the two electrodes 24, 25. An actual differential angle of rotation DW between the camshaft 2 and the crankshaft is fed to the high-voltage module 31 by a cam angle generator 33 or a crank angle generator 34 acting as a sensor.

In the high-voltage module 31, characteristic diagrams K are integrated in which, as a function of parameters of the internal-combustion engine fed to the module 31, such as the rotational speed n, the load L and the oil temperature TO, optimal differential angles of rotation DW are stored which correspond to the respective operating condition. In lists B which are logically linked with the angle of rotation DW, the output voltages UA1, UA2 are stored in the module 31.

During the operation of the internal-combustion engine, the intermediate timing gear 7 is, for example, in the end position E1 corresponding to a rotational idling speed. A specific differential angle of rotation DW is assigned to this end position El which ensures a valve overlap, that is optimal for this operating condition, between the intake valves actuated by the camshaft 2 and the exhaust valves actuated by another camshaft which is not shown. The fluid F in the locking bearing 21 and in the annulus 17 is liquid. The locking bearing 21 rotates at the rotational speed of the camshaft 2 while a shear gradient occurs in the fluid situated in the annulus 17 because the intermediate timing gear bearing ring 16 is stationary with respect to the intermediate timing gear 7. The diaphragm spring 22 is in the position illustrated in the figure and therefore exercises no force on the intermediate timing gear 7.

On the basis of a value read from a characteristic diagram K for a differential angle of rotation DW which is optimal for a medium rotational speed of an internal-combustion engine, an output voltage UA2 is determined from the list B. The output voltage UA2 causes the viscosity of the fluid F in the annulus 17 to change in the direction of "solid" because of the electric field acting between the electrode 25 and the intermediate timing gear 7. The increased viscosity causes a braking moment MB acting upon the intermediate timing gear 7 which is determined by the frictional force between the fluid F and the sleeve 9 as well as the outer radius of this sleeve 9. Because of the helical toothings 5, 6 and 10, 11, the braking moment MB causes an axial force FAX which overcomes the self-locking and displaces the intermediate timing gear 7 in the direction of the second end position E2 against the spring force FFE applied by the diaphragm spring 22.

The cam driving torque transmitted by the crankshaft to the camshaft 2 takes place non-uniformly because of the charge cycle valves which are to be actuated in a time-staggered manner and the spring forces which have to be overcome in the process. For one camshaft rotation, this driving torque passes several times through values between +20 Nm and −20 Nm. This non-uniformity causes a alightly oscillating axial relative movement of the intermediate timing gear 7 with respect to the camshaft 7 which is damped by the diaphragm spring 22. When the angle transmitters 33, 34 report the reaching of the desired differential angle of rotation DW to which a certain position of the intermediate timing gear 7 responds between the end positions E1 and E2, the changing of the relative rotating position is terminated in that the voltage UA2 drops and, as a result, the viscosity of the fluid F in the annulus 17 is changed in the "liquid" direction. The braking torque MB and the displacing force FAX fall off. For compensation of the spring force FFE, another output voltage UA1 fed to the electrode 24 causes a change of viscosity of the locking bearing 21 in the "solid" direction so that a radial pressure force between segment 23 and sleeve 9, because of surf ace friction, changes into an axial locking force FAF. The direction of the locking force FAF depends on the force FAX or FFE acting upon the intermediate timing gear 7. As a result, for each position of the intermediate timing gear 7 between the end positions E1, E2, an equilibrium of forces is reached between oppositely acting forces FAF and FFE.

When the intermediate timing gear 7 is to be shifted into the second end position E2, this position can be achieved by a constant application of the output voltage UA2 or in the manner described above for any intermediate position. The restoring of the intermediate timing gear 7 in the direction of the end position El takes place by switching-off of the output voltage UA2 and the lowering of the voltage UA1 to a value which causes the force FAF to fall below the value of the spring force FFE so that this spring force FFE displaces the intermediate timing gear 7. In this case, the force F" resulting from the locking bearing 21 has a damping effect on the oscillating relative movement of the intermediate timing gear 7.

For a required adjusting angle of the camshaft 2 of, for example, 15° and a maximal adjusting path between the end positions E1 and E2 of, for example, 6 mm, an adjusting time of below 0.1 seconds can be achieved by means of this arrangement. In this case, the electric power requirement of the high-voltage module 31 is lower than 5 watts, and the outside diameter of the driving wheel 4 is smaller than 100 mm.

The physical design of the arrangement can be adapted within wide ranges to the constructional conditions of the internal combustion engine. The dimensioning of the arrangement may be influenced, for example, by the toothing angle of the helical toothings 5, 6 and 10, 11, the required adjusting angle of the camshaft 2, the composition of the used fluid F, and the roughness of the surfaces wetted by the fluid F.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for automatically controlled varying of a relative rotating position of two shafts in an internal-combustion engine, said shafts including a camshaft and a second shaft, the camshaft being rotatable relative to said second shaft as a function of parameters of said internal-combustion engine, the arrangement comprising:

a driving wheel which drives the camshaft and carries a first set of gear teeth;

a second set of gear teeth connected with the camshaft with at least one of the first and second sets of gear teeth being a set of helical gear teeth;

an intermediate timing gear axially displaceable between at least two end positions and arranged between the driving wheel and the camshaft to act upon the second set of gear teeth;

a stationary intermediate timing gear bearing ring which coaxially surrounds the intermediate timing gear at least in sections and bounds an annulus formed between the bearing ring and the intermediate timing gear;

a fluid in the annulus, said fluid having a viscosity which can be changed by application of voltage;

an electronic control device coupled to apply a first output voltage to the fluid, wherein application of the first output voltage to the fluid creates a braking moment that acts on the intermediate timing gear, the braking moment causing an axial force that displaces the intermediate timing gear towards one of the end positions.

2. An arrangement according to claim 1, wherein both the first set of gear teeth and the second set of gear teeth are sets of helical gear teeth.

3. An arrangement according to claim 1, further comprising a spring between the camshaft and the intermediate timing gear, said spring loading the intermediate timing gear in the direction of one of the end positions a spring force of the spring.

4. An arrangement according to claim 1, further comprising a locking bearing which is coaxial between the camshaft and the intermediate timing gear and is filled with said fluid, wherein the control device is further coupled to apply a second output voltage to the fluid in the locking bearing, wherein application of the second output voltage to the fluid in the locking bearing creates an axial locking force which is opposite to a moving direction of the intermediate timing gear and which acts upon the intermediate timing gear.

5. An arrangement according to claim 1, further comprising radially acting sealing rings which bound the intermediate timing gear bearing ring on both sides.

6. An arrangement according to claim 4, further comprising radially acting sealing rings that bound the locking bearing on both sides.

7. An arrangement according to claim 4, further comprising a first electrode arranged adjacent the locking bearing in an insulated manner on a segment of the camshaft.

8. An arrangement according to claim 7, further comprising a second electrode arranged adjacent the annulus in an insulated manner in the intermediate timing gear bearing ring.

9. An arrangement according to claim 8, wherein the first and second electrodes are connected via electrically conducting connections 32 to a high-voltage module of the control device.

10. An arrangement according to claim 9, further comprising sensors which detect a current differential angle of rotation and are connected to the high-voltage module.

11. An arrangement according to claim 1, wherein at least one characteristic diagram is integrated into the control device in which, as a function of parameters of the internal-combustion engine, optimal differential angles of rotation are stored.

12. An arrangement according to claim 1, wherein at least one list is integrated into the control device in which output voltages are stored which are assigned to the differential angles of rotation.

* * * * *